US006488200B1

(12) United States Patent
Jensen, Jr.

(10) Patent No.: US 6,488,200 B1
(45) Date of Patent: Dec. 3, 2002

(54) MULTI-FUNCTION CRATE-TRAY AND DISPLAY

(75) Inventor: Robert F. Jensen, Jr., Apple Valley, MN (US)

(73) Assignee: Cherokee Manufacturing, Inc., South St. Paul, MN (US)

( * ) Notice: Subject to any disclaimer, the term of this patent is extended or adjusted under 35 U.S.C. 154(b) by 3 days.

(21) Appl. No.: 09/650,928

(22) Filed: Aug. 29, 2000

(51) Int. Cl.[7] ..... B65D 21/032

(52) U.S. Cl. ..... 229/122.3; 206/508; 206/509; 229/915

(58) Field of Search ..... 229/122.3, 915, 229/198; 206/386, 508, 509, 512, 600; 414/802, 922, 923, 924

(56) References Cited

U.S. PATENT DOCUMENTS

| | | | | | |
|---|---|---|---|---|---|
| 1,767,629 | A | | 6/1930 | Walter | |
| 1,847,694 | A | * | 3/1932 | Kondolf | 229/198 |
| 1,901,530 | A | | 3/1933 | Pellymounter | |
| 2,341,374 | A | | 2/1944 | Gardner | |
| 2,698,709 | A | * | 1/1955 | Neuman | 229/198 |
| 2,719,664 | A | * | 10/1955 | Hester | 229/915 |
| 2,968,397 | A | * | 1/1961 | Cantrell, Sr. | 206/508 |
| 3,108,569 | A | | 10/1963 | Kundikoff | |
| 3,272,328 | A | | 9/1966 | Krzyzanowski | |
| 3,520,468 | A | * | 7/1970 | Wiemann | 206/508 |
| 3,917,157 | A | * | 11/1975 | Smith | 206/512 |
| 3,921,893 | A | | 11/1975 | Randle, Jr. | |
| 4,244,472 | A | | 1/1981 | Brown | 206/597 |
| 4,638,941 | A | * | 1/1987 | Watson | 229/915 |
| 5,145,060 | A | | 9/1992 | Maye | |
| 5,520,325 | A | | 5/1996 | Quaintance | |
| 5,950,911 | A | | 9/1999 | Naughton et al. | |
| 6,227,370 | B1 | * | 5/2001 | Earnshaw et al. | 206/509 |
| 6,270,007 | B1 | * | 8/2001 | Jensen, Jr. | 229/122.3 |

FOREIGN PATENT DOCUMENTS

| | | |
|---|---|---|
| DE | 197 48 799 A1 | 5/1999 |
| EP | 718 207 A1 | 6/1996 |

OTHER PUBLICATIONS

Wells, Ellen; "Getting It There", *Greenhouse Grower*, Mid Sep., 2000, pp. 26–27.

RFC Container Company, Inc.—Advertising, (publication date unknown).

Protective Packaging, Advertising, (publication date unknown).

T. R. Miller Mill Co., Inc., Advertising (publication date unknown).

* cited by examiner

*Primary Examiner*—Gary E. Elkins
(74) *Attorney, Agent, or Firm*—Oppenheimer Wolff & Donnelly LLP

(57) ABSTRACT

A crate-tray, for transporting and displaying goods that cannot be easily stacked. The crate-tray comprising a tray-deck having edges along the perimeter of the tray-deck; a plurality of tray-walls formed along the tray-deck edges; and a plurality of tabs with a corresponding plurality of hinges, the tabs incised on the tray-deck and positioned with the corresponding hinges generally along the edges of the tray-deck, the tabs capable of opening from the deck to an extended position.

50 Claims, 6 Drawing Sheets

MULTI-FUNCTION CRATE-TRAY AND DISPLAY

BACKGROUND OF THE INVENTION

The present invention relates to shipping containers and more specifically to stackable containers for shipping and displaying goods that cannot be easily stacked.

Since the 1980's, the members-only warehouse club industry has become popular with the buying public. These members-only warehouse clubs maintain low prices on their products sold in their club stores by discarding many of the frills and luxuries associated with traditional retail stores. In place of using the store front to display the products while much of the stock remains in a rear warehouse area, club stores often display their goods as delivered from the suppliers on shipping pallets. This method cuts costs associated with the traditional method of having store employees unpack the goods from the pallets and display them for the purchasers. The savings associated with goods on pallets may influence club stores to prefer dealing with suppliers who will ship their goods on such pallets.

Unfortunately, not all goods can be easily stacked and shipped on pallets. For example, nursery plants cannot readily be stacked upon each other during shipping. In the past, nurseries have had to "floor load" the plants. Floor loading consisted of manually loading each potted plant into a truck or trailer. After a first layer of plants were loaded, subsequent layers would be loaded by carefully moving aside the stems and leaves of the plants from the lower layer and placing potted plants strategically on top. Of course, this floor loading was time consuming and often caused damage to the plants.

A second method improved upon the floor loading method. In this method, metal shelves were installed in the shipping trailer. Plants were then loaded onto the various shelves. This decreased the amount of damage to the plants, but was still time consuming. In addition, the shelving units were heavy and expensive. The weight of the shelves increased shipping costs and the shelves would need to be returned to the nursery supplier at the supplier's expense.

A third way to ship plants was described in the pending application titled "STACKABLE TRANSPORT CRATE", Ser. No. 09/382,220, filed Aug. 24, 1999. In that application, a crate system of cardboard or similar material is described consisting of a bottom cap, crate walls, and a top cap. The bottom and top caps are 'lids' with the same shape—a deck surrounded by front and side walls. To function as the bottom cap, the lid is turned so that the walls extend upward from the deck. To function as the top cap, the lid is turned the opposite way, so that the walls extend downward from the deck. In this way, the two caps and the crate walls can be used to form a single crate. Once the crate is constructed, it can be filled with goods that cannot be easily stacked, such as potted plants, gift baskets, lamps, buckets of cut flowers, or gifts such as stuffed animals holding small balloons or flags, among other things. For goods that require ventilation, such as plants, the crate is equipped with a series of vents. The crate walls can be configured so that they do not extend fully around the crate's perimeter. This allows light and additional ventilation to reach the goods.

To transport crates after the crates have been filled with the plants or other goods, a set of crates can be stacked upon each other on shipping pallets. For example, a pallet could be loaded with two stacked crates. Then a second pallet could be placed on top of the crates followed by two more crates. To stabilize the crates during transport, strapping would be applied around the stack.

As with many inventions, the cardboard crates described in the above-referenced patent application, are not without their limitations. First, when a second crate is stacked upon a first crate, the second crate has a tendency to slide around. Sliding of the stacked crates may cause problems during transport.

Second, although cardboard offers significant weight savings to the prior metal shelving approach, the amount of cardboard used in the stackable crates described in the patent application can be decreased. One will noticed that all interior crates that are stacked have a bottom tray positioned next to another crate's top lid. It would be an improvement to replace the dual bottom/lid approach with a single divider which acts as both a lid to a lower crate and as a bottom to an upper crate.

A third limitation to the previously described crates is due not to the shipping of the goods, but rather to the use of the crates after arrival at the shipment destination. As mentioned above, club stores often display their goods as delivered from the suppliers on shipping pallets. Although club stores do not expend as many resources for displays as do retail stores, it is beneficial to present the goods in as pleasing manner as possible. Being able to better display goods shipped in crates would be an improvement.

SUMMARY OF THE INVENTION

This invention can be regarded as crate-tray element for a transport crate, the transport crate used for transporting and displaying goods that cannot be easily stacked. The crate-tray includes a tray-deck; tray-walls formed along the tray-deck's perimeter; and a series of tabs. The tabs can be incised on the tray-deck and positioned with their corresponding hinges generally along the tray-deck's edges. Such jointed-tabs are capable of opening from the deck to an extended position. The tabs can also be configured so that they are part of the folds that are used to construct the tray-deck from a single piece of cardboard or similar material. These wall-tabs do not have hinges.

The crate-trays have three primary uses. First, they can be used in forming a series of stacked crates. A crate bottom forms the foundation of a stack of crates. Crate walls are added on top of the crate bottom. Then a crate-tray of the present invention acts as the crate's lid as well as the bottom for the next crate. Another set of crate walls are added on top of the crate-tray to form the second crate. The crate-tray's tabs (either of the jointed-tab variety or the wall-tab variety) assist in buttressing the crate walls. Once the desired number of crates are achieved, a crate lid is added to close the topmost crate of the stack.

A second use of the tray-crate is to replace the crate bottom and crate lid previously described. In such a situation, a crate-tray forms the foundation of the crate stack. Crate walls and crate-trays are alternately placed to form a series of crates. A final crate-tray is used as a lid to close the topmost crate of the stack.

The third use of the tray-crate occurs after the stacked crates are at their destination. The tray-crate at the top of the stack, which is acting as a lid, can be inverted and secured to form a display shelf. Some of the goods within the crates can be removed and placed on this display shelf.

DETAILED DESCRIPTION OF PREFERRED EMBODIMENTS OF THE INVENTION

Figures 1, 2:
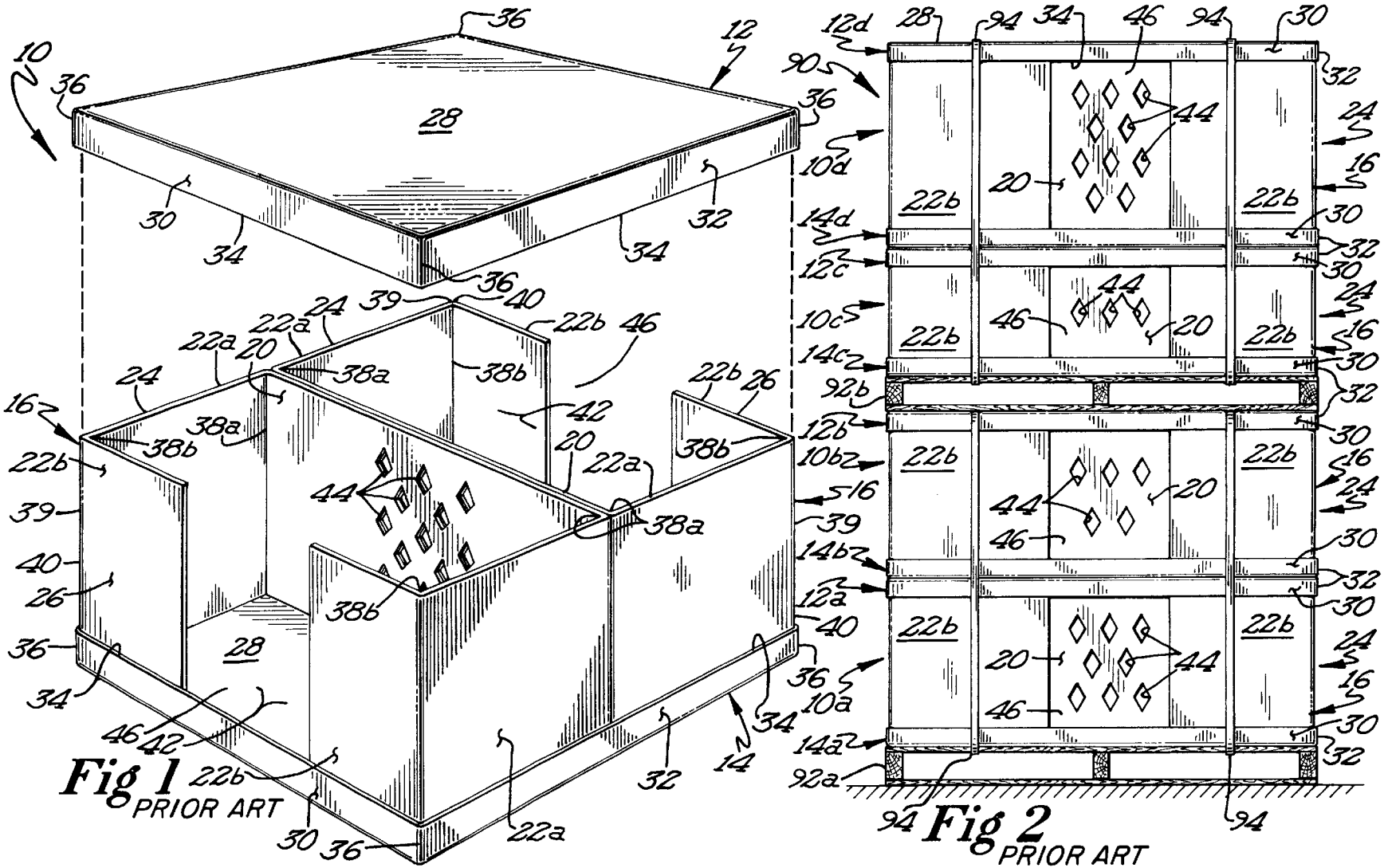
Fig 2 PRIOR ART
Fig 1 PRIOR ART
FIG. 1 is an exploded perspective view of a stackable transport crate, as disclosed in the prior art.
FIG. 2 is a plan view of four crates stacked for transport, as disclosed in the prior art.

FIGS. 1 and 2 show the prior art for stackable crates made of cardboard or similar material. FIG. 1 shows an exploded view of one such crate from the prior art. Crate 10 is made up of a bottom cap 14, crate walls 16 and a top cap 12. The bottom cap 14 and top cap 12 can be trays of a similar nature, each having a deck 28 surrounding by front walls 30 and side walls 32. For the bottom cap 14, the tray is positioned so that the walls 30 and 32 extend upward from the deck 28. For the top cap 12, the tray is positioned the opposite way, so that the walls 30 and 32 extend downward from the deck. In this way, the walls 30 and 32 of the trays enclose the crate walls 16.

Once the crate is constructed, it can be filled with goods that cannot be easily stacked, such as potted plants, gift baskets, lamps, buckets of cut flowers, or gifts such as stuffed animals holding small balloons or flags, among other things. For goods that require ventilation, such as plants, the crate is equipped with a series of vents 44. The crate walls 16 can be configured so that they do not extend fully around the crate's perimeter. This allows light and additional ventilation to reach the goods.

To transport crates after the crates have been filled with the plants or other goods, multiple crates can be stacked upon each other on shipping pallets. FIG. 2 shows a side plan view of one configuration in the prior art where four crates from FIG. 1 have been stacked. The pallet 92*a* is at the bottom, followed by the first crate 10*a,* the second crate 10*b,* another pallet 92*b,* the third crate 10*c,* and the fourth crate 10*d.* To stabilize the crates during transport, strapping 94 is applied around the crates.

Although the stackable crates of the prior art shown in FIGS. 1 and 2 are a great improvement over what was used in prior times, there are still improvements that can be made to them. The trays used as the top and bottom caps 12 and 14 can be improved. Notice in FIG. 2 that when crates are stacked, the top cap of the bottom crate 12*a* is situation immediately below the bottom cap 14*b* of the second lowest crate. This situation of having two caps next to each other occurs for each of the crates except at the very top and the very bottom of the stack.

A bottom cap (such as 14*b*) resting on a top cap (such as 12*a*) can be improved in at least two ways. First, the adjoining caps can cause the crates to slide or otherwise shift during transport. The strapping 94 is applied to prevent such shifting. The crate of the present invention seeks to inhibit the shifting of the stacked crates. Second, the adjoining caps are redundant. There is no need to have two caps separating two crates; one separating cap will suffice.

The remaining drawings show how the present invention improves upon the prior art. FIG. 3 shows four crates 100*a,* 100*b,* 100*c,* and 100*d* stacked on pallets 140, similar to the four crates of FIG. 2, but this time utilizing the present invention. The topmost crate 100*d* is made up of three primary components: crate-cover 105*d,* crate-walls 145*d* and crate-tray 115. The next crate 100*c* is also made up of three primary components: crate-tray 115, crate-walls 145*c,* and crate-cover 110*c*. Notice that the two crates share the crate-tray 115. The crate-tray 115 acts as a bottom for the first crate 100*d* and as a top lid for the next crate 100*c*.

The crate-walls 145 are described in more detail in the prior art, including the "STACKABLE TRANSPORT CRATE" application, Ser. No. 09/382,220. Crate-walls 145 can be formed numerous ways. In one method, a crate-wall is a generally rectangular piece and four such crate-walls are used to form the four sides to the crate. In another method, a one piece crate-wall can be folded around to form all four sides to the crate. In yet another method, two crate-walls can be used. Each of these crate-walls form an interior crate-wall as well as portions of the exterior crate sides. Crate-walls of all sorts can be constructed so that they do not entirely enclose all sides of the crate. Portions of the sides of the crates can remain without crate-walls so that light and ventilation can reach the contents of the crates.

In FIG. 3, a bottom pallet 140 is shown upon which two crates 100*a* and 100*b* are placed. On top of these crates, another intermediate pallet 140 is stacked followed by two more crates 100*c* and 100*d.* This is but one configuration of how crates can be stacked for transport. The intermediate pallet 140 is not necessary for any structural purpose. Instead, intermediate pallet 140 may be introduced into the stack of crates for practical purposes. For example, perhaps the crates will be shipped together, but unloaded at two different club stores. With an intermediate pallet 140 in place, the top two crates 100*c* and 100*d,* along with intermediate pallet 140, can be unloaded from the shipping truck at the first club store. Then the remaining two crates 100*a* and 100*b* along with the bottom pallet 140 can be unloaded at the second store. More than two crates can be stacked on top of one another, using crate-tray 115 between each crate. For example, a single pallet 140 might be loaded with four or six stacked crates, without any intermediate pallets.

Figure 3A:
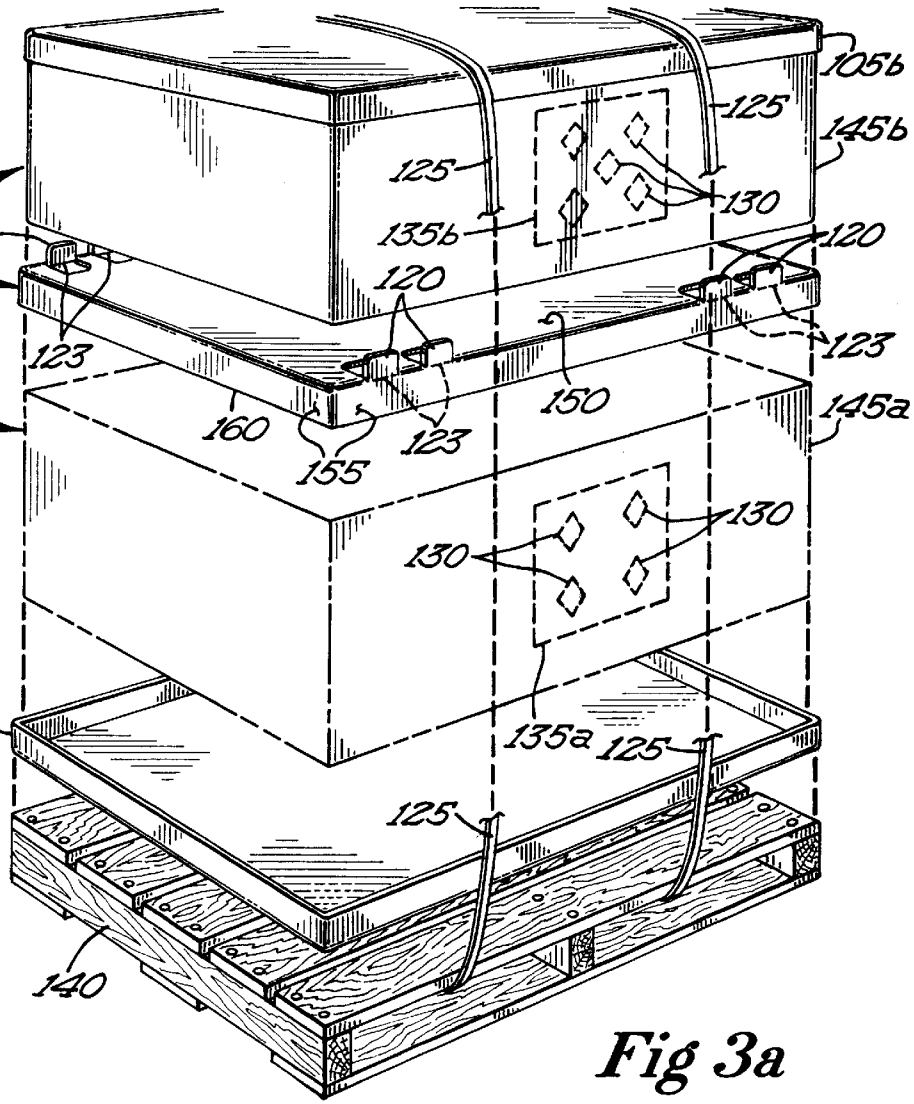
FIG. 3*a* is an exploded view of the lower pallet and bottom two crates from FIG. 3.
Figure 3:
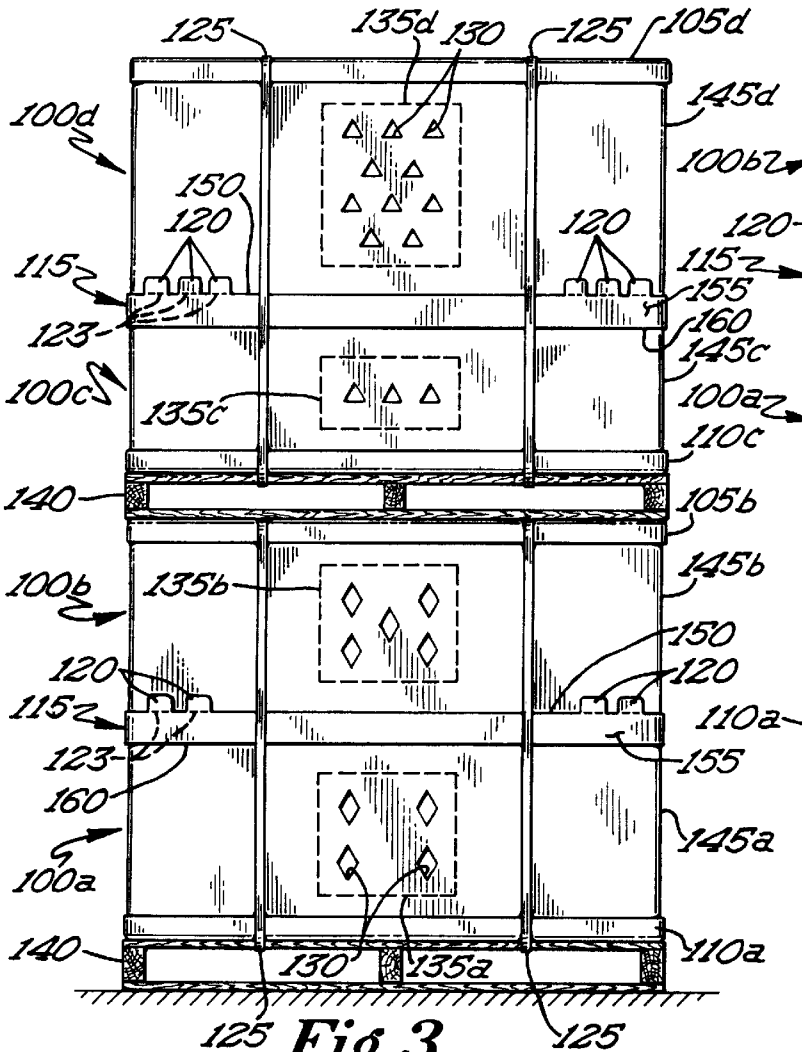
FIG. 3 is a plan view of four crates stacked for transport.

To more fully illustrate how the elements fit together to form a set of stacked crates, FIG. 3*a* is provided to show an exploded view of two crates on a pallet. In this view, one can see how crate-tray 115 is shared between two adjacent crates.

Once the stack of crates have been constructed, they can be filled with goods that are fragile or which do not stack easily. For additional structural integrity, before the goods are placed in the crates, a crate pad can be added to any of the crates. A crate pad is simply a piece of corrugated cardboard, plastic, composite, or other material which has been formed so that it can be placed on a crate-tray's deck region. The added material of the crate pad lends strength to the crate-tray, allowing more goods to be placed within the crate.

Although strapping has been shown in the figures as a means for further securing the set of stacked crates, other means can also be used. One such means is the use of shrink-wrap plastic. Once the crates are constructed and the items are loaded into the crates, shrink-wrap can be stretched around the crates. One portion of shrink-wrap can be wrapped around the lid to secure it. Other portions of shrink-wrap can be wrapped around each of the crate-trays. If a crate pad is used, when the shrink wrap is shrunk, the crate walls may be squeezed inwards to the point of the crate pad. In this way, the crate pad, crate walls, and the crate-tray are 'locked' into position and remain very secure during transport. Although any width of shrink-wrap may be used, oftentimes 12-inch or 18-inch shrink-wrap will be used.

Almost every industry can benefit from the present invention. Nurseries can use the stack of crates to ship potted plants, seedlings, or shrubs. Wholesale florists can ship and display buckets of cut flowers with the stacked crates. The automotive and home electronics industries can use the stacked crates provided by the present invention to store and transport parts and subassemblies for their assembly lines. Cars, computers, video equipment, television equipment, and other types of assembled goods contain plastic or otherwise fragile pieces or non-stackable items that could be packed in the stacked crates without damage. These industries can use the stacked crates as "parts lockers" by storing different pieces needed by the assembly line in the separate crates.

For example, a supplier for the automobile factory could place the separate pieces and controls that make up the dashboard into the separate crates. The stacked crates could be delivered to the automotive factory's assembly floor. The assembly crew could then easily install the dashboard into the cars because the necessary parts would be organized near each other in the various crates. Once the supply of parts was depleted from the set of stacked crates, the stack of crates could be replaced with a new set of parts in crates. Because the crates are made of cardboard or similar material, the emptied crates can be readily crushed and destroyed.

Figure 4:
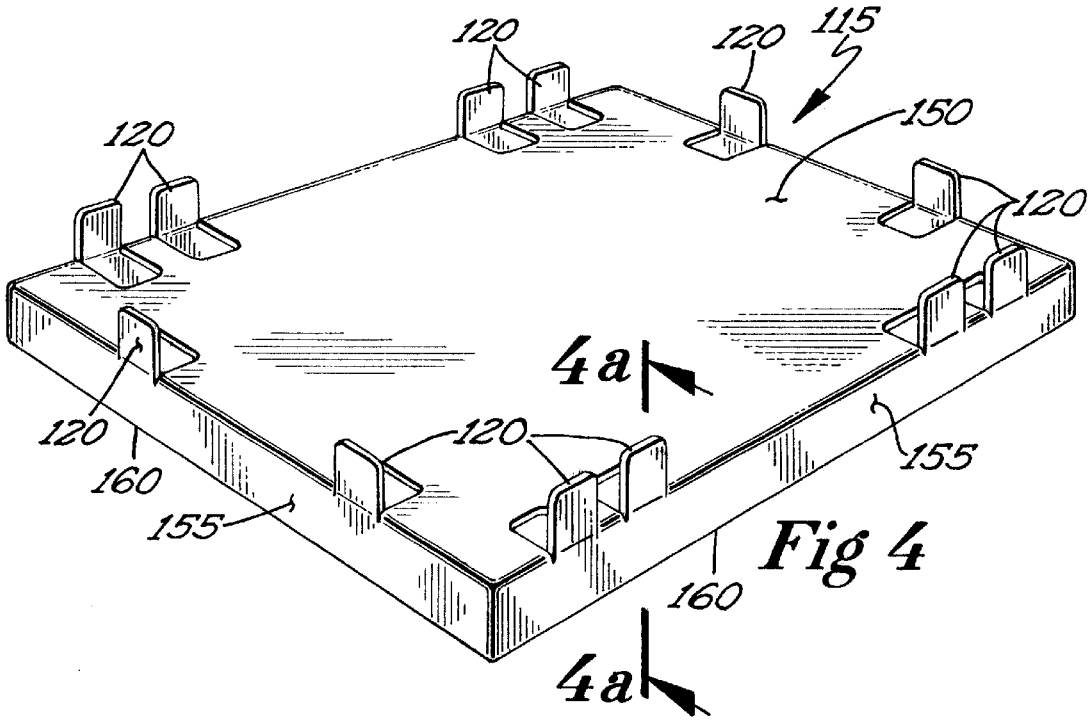
FIG. 4 is a perspective view of a crate-tray.

Returning to the crate-tray itself, FIG. 4 shows crate-tray 115 in more detail. crate-tray 115 shares similar features of the caps which it has replaced. The crate-tray 115 contains a tray-deck 150 surrounded by tray-walls 155. Tray-deck 150 is generally rectangular in shape, although it need not be a true rectangular. In the spirit of the present invention, crates and crate-trays could be formed in other shapes, such as hexagons, squares, etc. The crate-walls form a lip 160. However, unlike the previous caps, the crate-tray 115 also has a series of tabs 120. The tabs can be constructed in various ways. Here, tabs 120 are shown as jointed-tabs with hinges 123. The jointed-tabs 120 are coplanar to the tray-walls 155 of the crate-tray 115 and are generally perpendicular to the tray-deck 150. It is not necessary that the jointed-tabs 120 be exactly perpendicular to the tray-deck 150, nor is it necessary that each jointed-tab 120 be the same length, width, or relative position as other tabs 120. The jointed-tabs 120 can be positioned on just two opposing sides of tray-deck 150, as shown here, the jointed-tabs 120 can be positioned on all sides of the tray-deck 150, or the jointed-tabs 120 can be positioned on any number of sides.

Figure 4A:
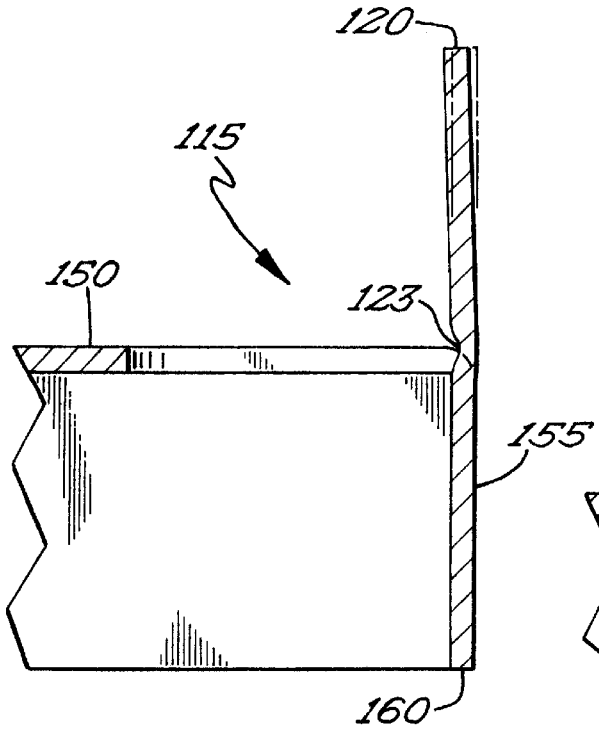
FIG. 4*a* is a detailed cross-sectional view of jointed-tabs from the crate-tray having compressed hinges.

The hinges 123 for the jointed-tabs can be manufactured in several ways. FIG. 4*a* illustrates one method for forming hinges 123. Here, jointed-tab 120 is attached to tray-deck 150 by hinge 123. Hinge 123 is formed by compressing a line on the tray-deck's surface which is the interior surface once the crate-tray 115 is folded into position. By compressing the line on the interior surface of the crate-tray 115, that side of jointed-tab 120 is slightly shortened. Having one side of jointed-tab 120 slightly shortened causes a small arcing of the jointed-tab 120. When the jointed-tab 120 is in its extended position, the jointed-tab 120 arcs slightly towards the interior of crate-tray 115. The curvature of jointed-tab 120 provides additional structural strength to jointed-tab 120 so that while in its extended position, jointed-tab 120 has the tendency to not overextend past the plane of tray-walls 155. In other words, jointed-tab 120 tends to 'grip' tray-walls 155 because of this form of hinge construction. In some cases, jointed-tabs 120 with arcing characteristic may not need to be secured to tray-walls 155 with additional means, such as staples or adhesive.

Figure 4B:
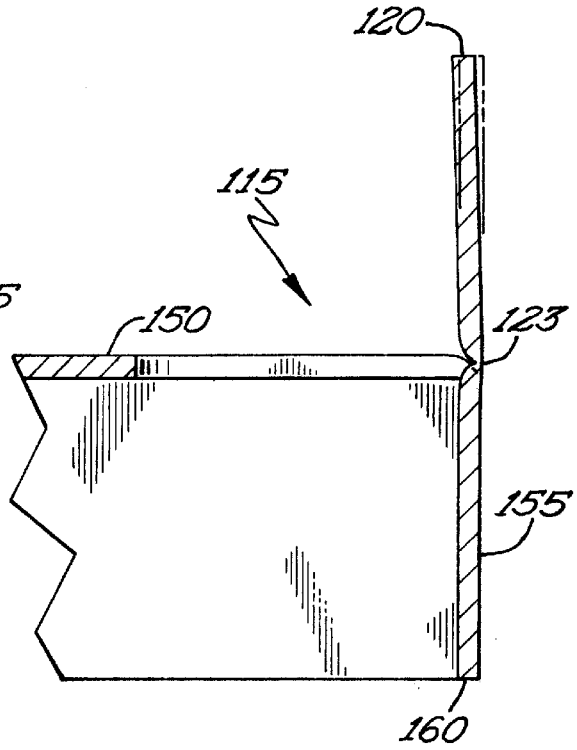
FIG. 4*b* is a detailed cross-sectional view of jointed-tabs from the crate-tray having scored hinges.

FIG. 4*b* illustrates an alternative formation of hinges 123. Here, a line is scored on the tray-deck 150 to form hinge 123.

The crate-tray acts as a lid to a crate by enclosing the crate walls 145 within the tray-walls 155. The crate-tray 115 also acts as a quasi-lid to the crate positioned on top of crate-tray 115 because the jointed-tabs 120 form a series of lid-like walls which can surround the crate-walls 145.

Sharing one crate-ray 115 for two crates saves on materials needed to construct the crates. There is also a savings in transportation costs since the stacked crates weigh less and because there are fewer pieces to be assembled.

Figure 5:
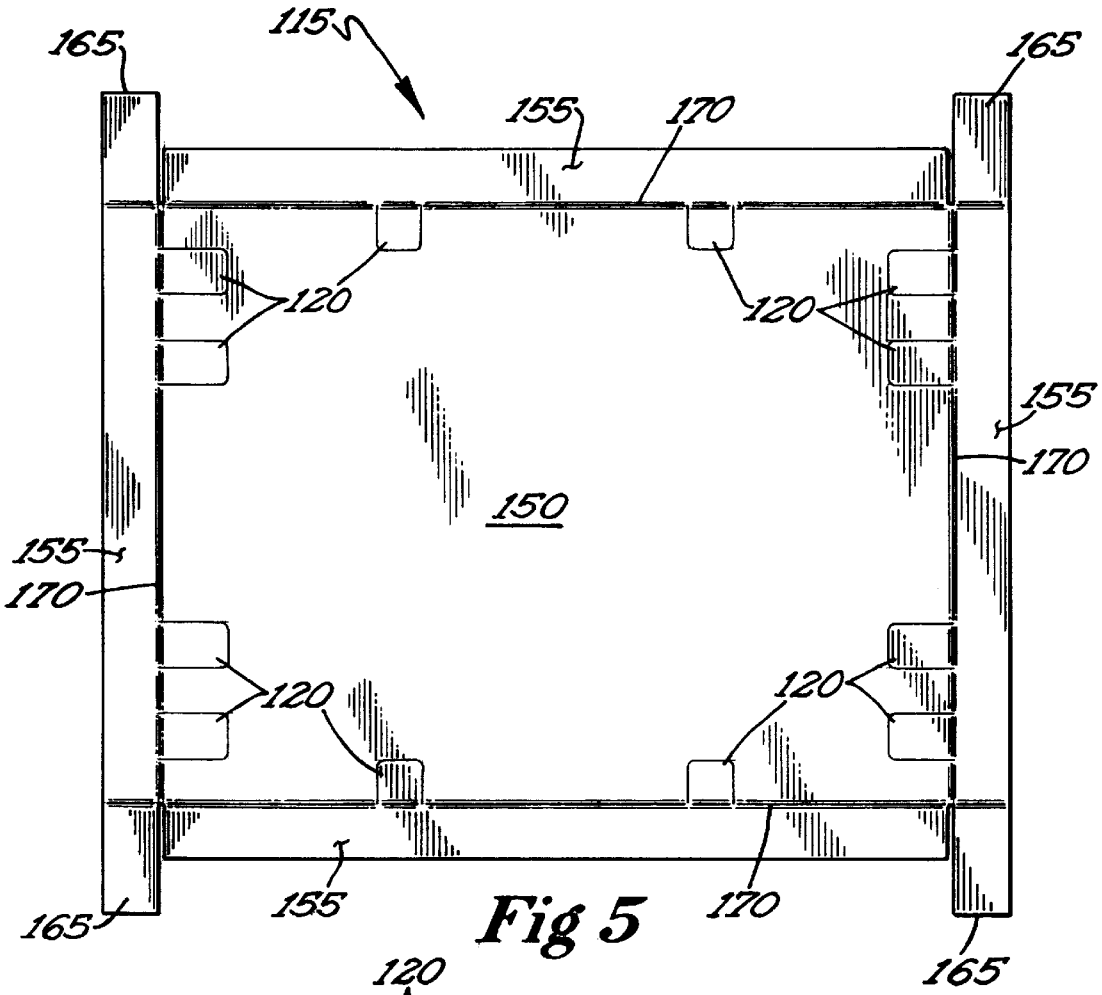
FIG. 5 is a top plan view of a crate-tray with hinged jointed-tabs prior to being folded and assembled.
Figure 5A:
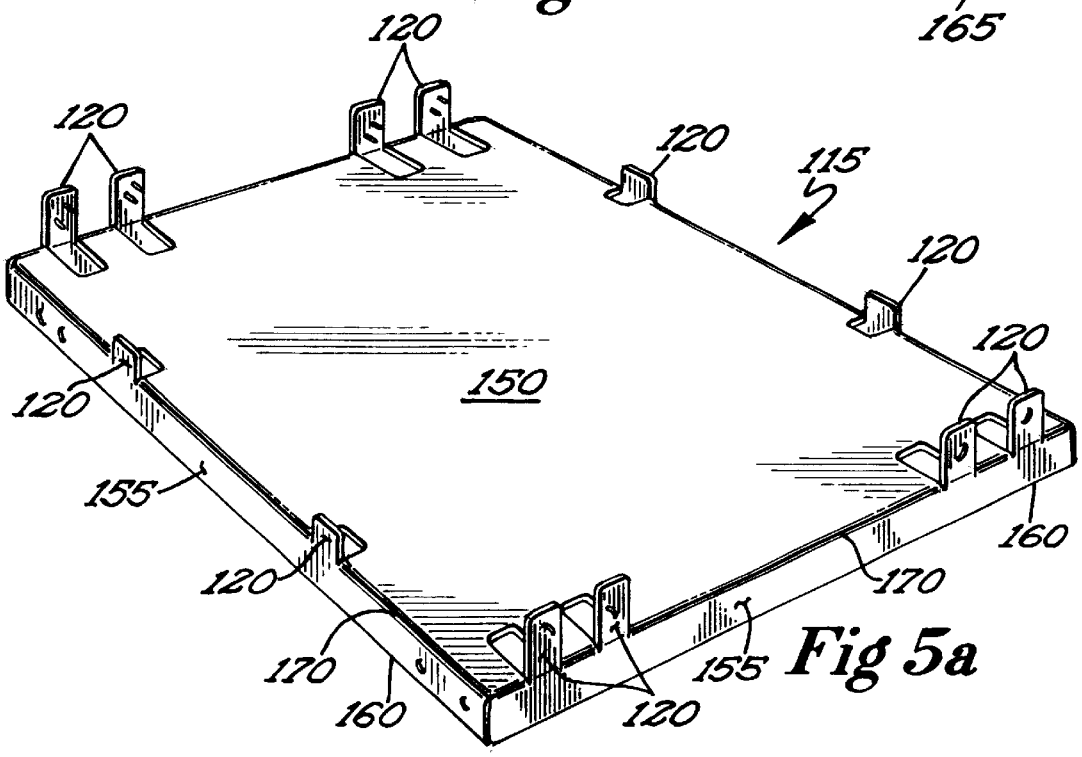
FIG. 5*a* is a perspective view of the FIG. 5 crate-tray folded into position.

As previously mentioned, the tabs 120 can be formed in different ways. The tabs in FIGS. 3*a,* 4, 4*a,* and 4*b* have been constructed with hinges. Thus, these tabs 120 can be referred to as jointed-tabs 120. FIG. 5 shows the construction of jointed-tabs 120 in more detail. Here, crate-tray 115 is formed from a flat piece of material, such as cardboard, which may be treated to make it water resistant, crate-tray 115 can also be constructed from plastic, composite, multiple layers of corrugated cardboard laminated together, or other material. The tray-deck 150 is shown in the center. Fold lines 170 allow the edges of the piece to be folded upwards to construct the tray-walls 155. Sleeves 165 from two of the tray-walls 155 can be folded to meet the adjacent tray-walls. Sleeves can be secured with staples, adhesive or other form of attachment, to form the three-dimensional crate-tray 115. FIG. 5*a* shows a perspective view of crate-tray 115 after it is folded into position. In FIGS. 5 and 5*a,* the jointed-tabs 120 are die cut from the tray-deck 150. The jointed-tabs 120 can be extended by folding them in the opposite direction from that which the tray-walls were folded. For additional strength, the jointed-tabs 120 can be secured, such as with staples, to the crate-walls 145 that the tabs 120 enclose. Instead of staples, the jointed-tabs could also be secured by other means, such as with glue, rivets, or hook and loop fasteners.

Figure 6:
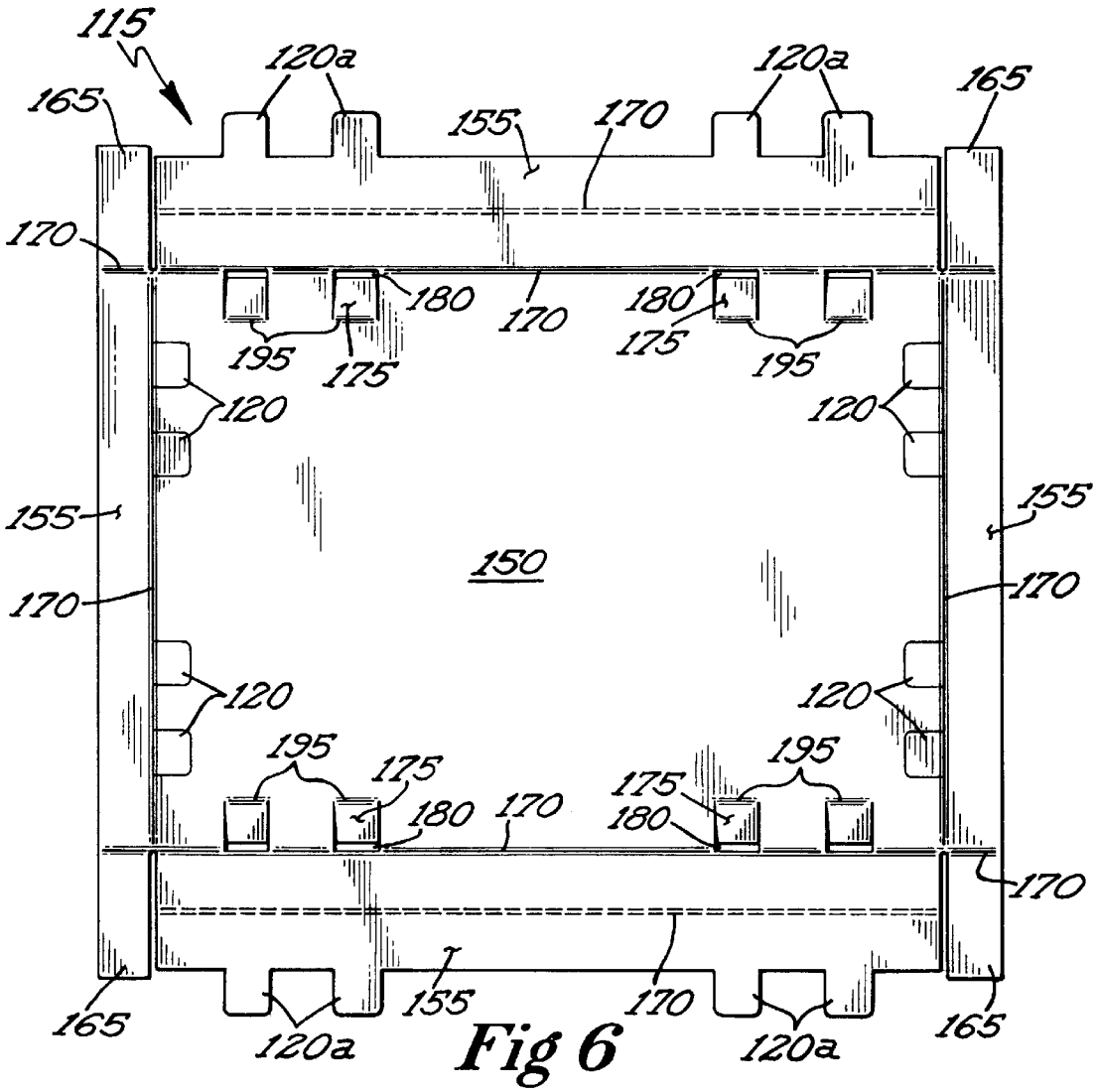
FIG. 6 is a top plan view of a crate-tray with jointed-tabs and wall-tabs prior to being folded and assembled.

Another way to form the tabs is shown in FIG. 6. Here, instead of using jointed-tabs 120, the tabs are appendages from the wall pieces. Thus, this type of tab construction can be referred to as wall-tabs 120. By using wall-tabs 120, staples or other fasteners are not needed because the flat piece can be turned into the three-dimensional crate-tray 115 simply by folding the tray-walls 155 up from the tray-deck 150 along folding lines 170 and securing the tray-walls 155 with the sleeves 165 and a series of locking-tabs 175 and locking-slots 180. Notice that in FIG. 6, the wall-tabs 120 (here 120*a*) of the present invention serve the dual purpose of being tabs to enclose the crate walls (as was also done in FIG. 5 by the jointed-tabs 120) as well as locking tabs for forming the crate-tray 115 itself without the need of staples. Alternatively, there could be a set of wall-tabs provided for constructing the crate-tray 115 and another set of jointed-tabs 120 for securing the tray-walls 155. Tray 115 of FIG. 6 also includes die cut jointed-tabs 120 in addition to the stronger wall-tabs 120*a*. Wall-tabs 120*a* may be stronger than jointed-tabs 120 due to their construction with the fold lines 170 and locking-tabs 175 and locking-slots 180. The wall-tabs 120*a* are strong enough so that the crate walls can be placed within the confines of the extended tabs 120*a* and no stapling or other form of securing is needed. However, during transport, strapping may still be applied.

Figure 6A:
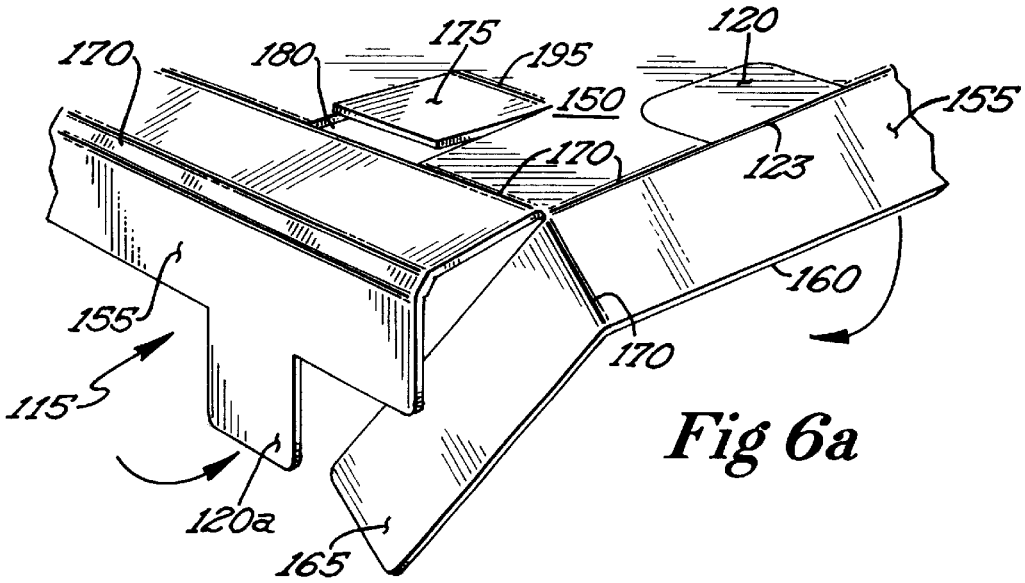
FIG. 6*a* is a partial perspective of a comer of the crate-tray shown in FIG. 6 and showing the folding sequence.
Figure 6B:
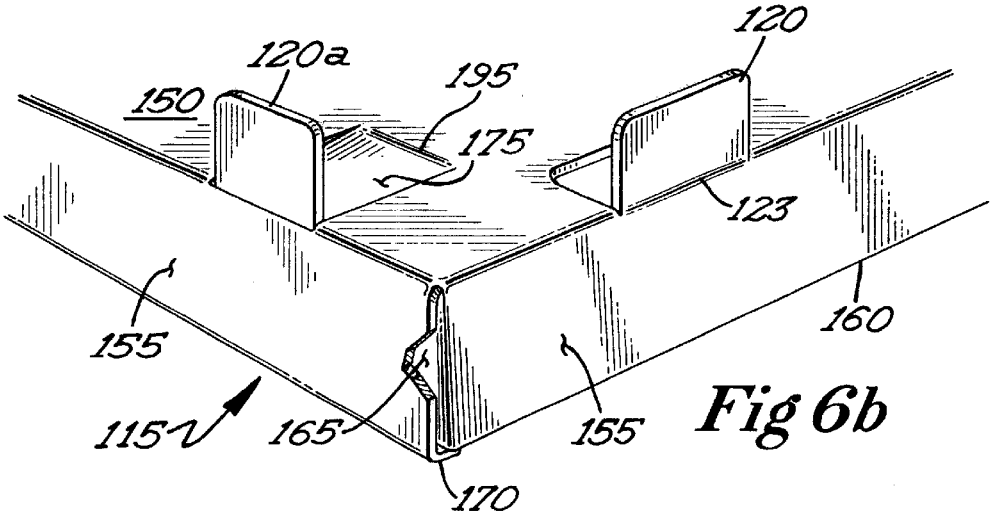
FIG. 6*b* is a partial perspective of comer, showing the folding and locking from FIG. 6*a* completed.

FIG. 6*a* provides a detailed illustration of how locking-tabs 175 and locking-slots 180 are used to assemble crate-tray 115 into its three-dimensional form. To assemble crate-tray 115, tray-walls 155 are formed by folding them down along fold lines 170. Sleeve 165 is folded and placed between the double walls of the adjoining side. Locking-tab 175 is lifted up from hinge 195. Then wall-tab 120*a* is inserted through locking-slot 180. To secure the wall-tab 120*a,* locking-slot 175 is pressed downwards so that it is again generally co-planar with the tray-deck 150. FIG. 6*b* provides an illustration of the crate-tray 115 shown in FIG. 6*b* after the crate-tray 115 has been folded and locked into position.

As previously discussed, the crate-tray 115 allows the shipper to construct stacked crates with fewer elements since crate-tray 115 can act as a lid for a lower crate and as a bottom for an upper crate. This means that the shipper must keep on hand three elements for crate construction: (1) lids which are used as the bottom for the bottom most crate in a stacked set and as the top for the topmost crate, (2) crate-trays-forms which are used to construct crate-trays between two crates in the stacked set; and (3) crate-walls for the crates. However, the crate-trays of the present invention can also be used as a bottom or as a lid of a crate. In such a situation, the shipper only needs to keep two elements on hand for crate construction: crate-trays and crate-walls. The shipper begins building a stacked set of crates by using crate-tray 115 as a bottom for the lowest crate. Then the first crate-walls 145 are used, followed by a crate-tray 115 as a separator between crates, followed by another set of crate-walls 145. This continues to the top of the stacked set where crate-tray 115 can be used as the lid to the stacked set. Needing only two elements to form the crates is advantageous to the shipper since the shipper does not need to maintain an adequate store of the lids.

Another improvement offered by the present invention becomes apparent after transport. As noted above, club stores prefer receiving shipments of goods on pallets. The club stores can then move the pallets to the inside of their warehouse-type stores and their customers pick the goods directly out of the shipping boxes. The club stores do not often unpack the goods and create a stylish display for them. Referring again to FIG. 3, note that the present invention offers removable knock-out windows 135 which are manufactured so that they can be punched out after transport. Such knock-out windows 135 offer even greater ventilation and light to enter the crates. This is beneficial when the goods are potted plants or cut flowers. The knock-out windows 135 allow the customer to more readily see the contents of the crates and for the goods to be more prominently displayed. If the crates are being used to store parts for an assembly line, the knock-out windows 135 allow workers to see and remove the parts with ease.

Figure 7:
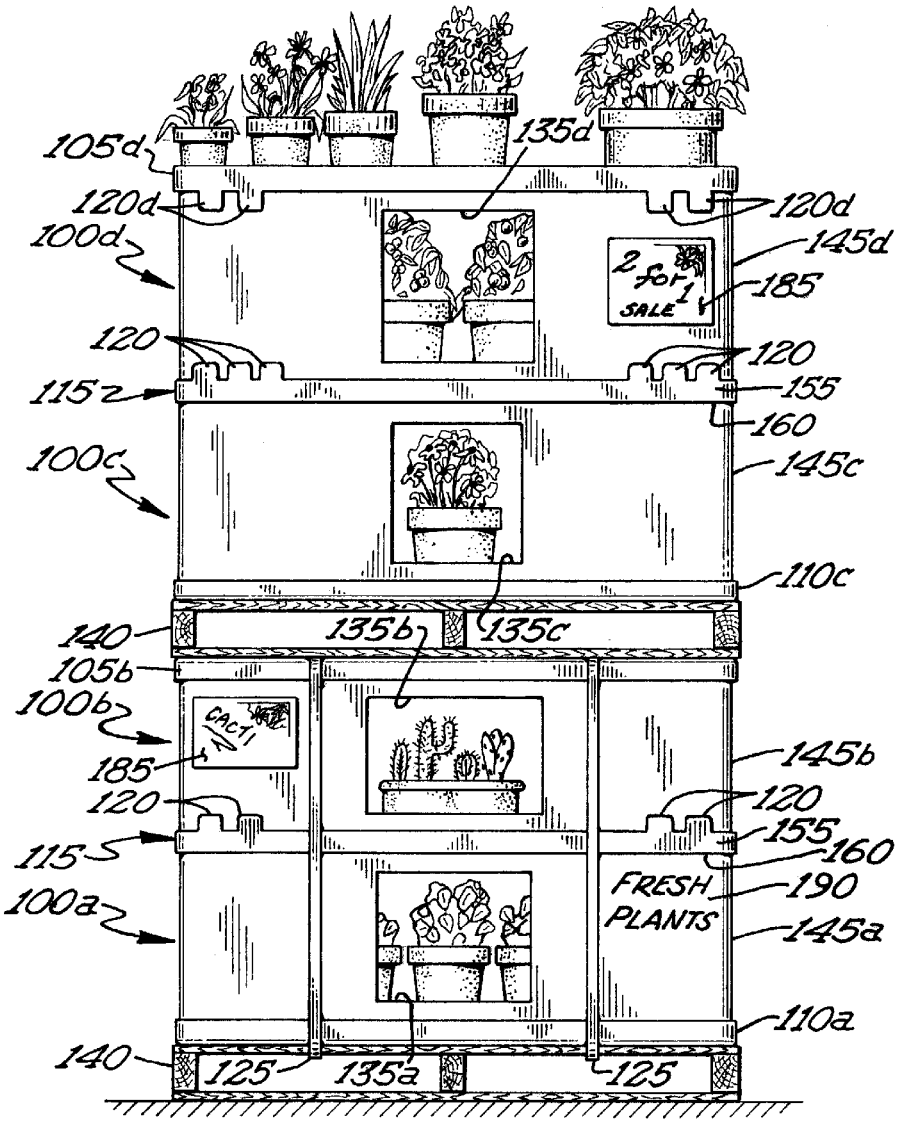
FIG. 7 is a plan view of four crates stacked, after transport to a retailer, the topmost crate-tray modified for display purposes.

FIG. 7 shows a representation of four stacked crates as they might appear after transport to a retailer, such as to a club store. The knock-out windows 135 have been removed to reveal potted plants in the crates. Some of the crate-walls 145 have been manufactured to include pre-printed advertisement or marketing material 190. Other crate-walls have been designed to allow printed marketing material or other signage to be attached by the retailer 185. To further enhance the display and to make it more safe, the upper most crate-tray 105*d* (which is of the same form as element 115) has been reversed. Whereas during transport, the crate-tray 105*d* was used as a lid for the stack of crates, by reversing it, the crate-tray 105*d* becomes a display shelf. Notice that in FIG. 7, some plants from the crates have been moved up to this display shelf area. The tray-walls of the crate-tray 105*d* form a protective ledge around the display shelf, so that consumers cannot accidentally knock the goods from the display shelf. To secure the display shelf, the tabs (which are of the jointed-tab variety here although the wall-tab variety might be used as well) may be anchored to the crate-walls 145*d*. Of course, although FIG. 7 shows plants as the represented goods, any other type of goods could be displayed in such stacked crates.

Crate-tray 115 can be manufactured according to the specific type of goods that will be stored, transported, and displayed within the crates. As previously discussed, crate-tray 115 can be formed from many types of materials. Often, these materials will be light-weight and disposable. For example, crate-tray 115 can be formed from cardboard, plastic, laminated layers of some form of material. The material used to form crate-tray can be treated to make it better suited for the goods which will be shipped. In FIG. 7, the stacked crates are shown displaying plants. In such a use, crate-tray 115 might be treated with a substance to make it more water resistant. If fruits or vegetables were shipped in the stacked crates, crate-tray 115 might be treated with a fungicide to prevent the formation of fungus during transport and display. If very fragile items are to be stored in the crates, perhaps crate-tray 115 would be treated with a plastic coating to prevent the goods from being scratched or scuffed when in contact with the crate-tray 115. Of course, if a crate pad is used in the construction of the stacked crates, the crate pad could also be treated in any of these manners.

From the foregoing detailed description, it will be evident that there are a number of changes, adaptations and modifications of the present invention which come within the province of those skilled in the art. However, it is intended that all such variations not departing from the spirit of the invention be considered as within the scope of the invention.

What is claimed is:

1. A crate-tray for a set of crates, for transporting or displaying goods that cannot be easily stacked, comprising:

a tray-deck having edges along the perimeter of the tray-deck;

a plurality of tray-walls formed along the tray-deck edges; and a plurality of jointed-tabs and a corresponding plurality of hinges, the jointed-tabs incised on the tray-deck and positioned with the corresponding hinges generally along the edges of the tray-deck, the jointed-tabs capable of opening from the deck to an extended position.

2. The crate-tray of claim 1, where there is one jointed-tab along each of the edges of the tray-deck.

3. The crate-tray of claim 1, where there are two jointed-tabs along each of the edges of the tray-deck.

4. The crate tray of claim 1, where there are four jointed-tabs along each of the edges of the tray-deck.

5. The crate-tray of claim 1, wherein the jointed-tabs are rigid when in their extended positions such that the jointed-tabs do not extend generally more than perpendicular from the tray-deck, in general alignment with the tray-walls.

6. The crate-tray of claim 1, wherein the jointed-tabs can be closed again to the tray-deck after the jointed-tabs have been extended.

7. The crate-tray of claim 1, wherein the extended jointed-tabs are configured such that the extended jointed-tabs can be secured to a plurality of crate-walls with staples.

8. The crate-tray of claim 1, wherein the extended jointed-tabs are configured such that the extended jointed-tabs can be secured to a plurality of crate-walls with adhesive.

9. The crate-tray of claim 1, wherein the extended jointed-tabs are configured such that the extended jointed-tabs can be secured to a plurality of crate-walls with rivets.

10. The crate-tray of claim 1, wherein the plurality of hinges each are a scored line on the tray-deck, generally along the edge of the tray-deck.

11. The crate-tray of claim 1, wherein the plurality of hinges compressed lines on the tray-deck, for enabling the jointed-tabs to extend along the hinges without the tendency to overextend.

12. The crate-tray of claim 1, wherein the crate-tray is formed from laminated corrugated cardboard.

13. A crate-tray for a crate, for transporting or displaying goods that cannot be easily stacked, comprising:

a tray-deck having a substantially rectangular shape and having four edges along the perimeter of the tray-deck;

a plurality of tray-walls formed along the edges of the tray-deck, wherein at least one of the tray-walls is a supportive tray-wall, the supportive tray-wall comprising an inner panel and an outer panel; and a wall-tab extending from the tray-deck in a generally perpendicular direction from the tray-deck and opposite from the tray-walls, the wall-tab formed as an appendage of the inner panel of the supportive tray-wall;

wherein the tray-deck, the tray-walls, and the wall-tab are formed from a single piece of material that is folded and secured such that the wall-tab extends through a slot in the tray-deck that is positioned substantially near one of the four edges of the perimeter of the tray-deck; and wherein the wall-tab extends through the slot and from the tray-deck such that the wall-tab provides support to a crate wall placed perpendicular to the tray-deck and the wall-tab substantially maintains the position of the crate wall.

14. The crate-tray of claim 13, wherein the tray-deck, the tray-walls, and the wall-tabs are secured with a plurality of locking-tabs and locking-slots.

15. The crate-tray of claim 13, wherein the tray-deck, the tray-walls, and the wall-tabs are secured with staples.

16. The crate-tray of claim 13, wherein the tray-deck, the tray-walls, and the wall-tabs are secured with adhesive.

17. The crate-tray of claim 13, wherein the tray-deck, the tray-walls, and the wall-tabs are secured with rivets.

18. The crate-tray of claim 13, wherein the crate-tray is formed from laminated corrugated cardboard.

19. The crate-tray of claim 13, also comprising a plurality of jointed-tabs and a corresponding plurality of hinges, the jointed-tabs incised on the tray-deck and positioned with the corresponding hinges generally along the edges of the tray-deck, the jointed-tabs capable of extending from the deck.

20. A method for transporting or displaying goods that cannot be easily stacked, comprising the steps of:

providing at least two crate-covers, each crate-cover comprising a cover-deck having a plurality of cover-walls formed along the edges of the cover-deck;

providing at least one crate-tray-form, each crate-tray-form comprising a tray-deck, a plurality of tray-walls formed along the edges of the tray-deck, and a plurality of jointed-tabs and accompanying hinges, the jointed-tabs incised on the tray-deck and positioned with the hinges generally along the edges of the tray-deck, the jointed-tabs capable of extending from the tray-deck;

providing a plurality of crate-walls, each crate-wall having a top side and a bottom side;

forming a crate-base by positioning one of the crate-covers so that the cover-walls extend upward from the cover-deck;

forming a first crate by positioning a first plurality of crate-walls from the plurality of crate-walls on the crate-base, the crate-walls positioned with their bottom sides on the crate-base and within the cover-walls of the crate-base, at least a portion of the crate-walls positioned alongside a portion of the cover-walls of the crate-base;

forming a crate-tray from one of the crate-tray-forms, such that the tray-walls of the tray-deck extend downwards from the tray-deck, enclosing the top sides of the first plurality of crate-walls, the jointed-tabs on the crate-cover opened in their extended position;

forming a second crate by positioning a second plurality of crate-walls from the plurality of crate-walls on the crate-tray, the crate-tray acting now like an intermediate crate-base with the jointed-tabs of the crate-tray acting similar to the cover-walls of the crate-base;

repeating the steps of forming crates and crate-trays as desired; and forming a crate-lid by positioning one of the crate-covers so that the cover-walls extend downward from the cover-deck.

21. The method for transporting or displaying goods of claim 20, further comprising the step of fastening the jointed-tabs from each of the crate-trays to the crate-walls immediately above the crate-trays.

22. The method for transporting or displaying goods of claim 21, wherein the step of fastening the jointed-tabs comprises stapling the jointed-tabs with a stapler.

23. The method for transporting or displaying goods of claim 20, wherein the step of providing a plurality of crate-walls further comprises the step of providing at least one knock-out window in the crate-walls, the knock-out windows capable of being removed from the crate-walls for better displaying goods that are stored within the crates.

24. The method for transporting or displaying goods of claim 20, further comprising the step of placing a crate-pad on the crate-tray for increasing the structural strength of the crate-tray.

25. The method for transporting or displaying goods of claim 20, wherein at least one of the crate-walls has printed material the crate-wall.

26. The method for transporting or displaying goods of claim 20, further comprising the step of affixing printed material on at least one of the crate-walls for display purposes.

27. The method for transporting or displaying goods of claim 20, further comprising the step of loading the crates with a plurality of components, the components used for the assembly of a manufactured item.

28. A method for transporting or displaying goods that cannot be easily stacked, comprising the steps of:

providing a plurality of crate-tray-forms, the crate-tray-forms each comprising a tray-deck, a plurality of tray-walls formed along the edges of the tray-deck, and a plurality of jointed-tabs and accompanying hinges, the jointed-tabs incised on the tray-deck and positioned with the hinges generally along the edges of the tray-deck, the jointed-tabs capable of opening from the tray-deck to an extended position;

providing a plurality of crate-walls, each crate-wall having a top side and a bottom side;

forming a crate-base by positioning one of the plurality of crate-trays-so that the tray-walls extend upward from the tray-deck;

forming a first crate by positioning a first set of crate-walls, consisting of at least one crate-wall, on the crate-base, the first set of crate-walls positioned with the bottom sides of the crate-walls on the crate-base and within the tray-walls of the crate-base, with at least a portion of the first set of crate-walls positioned alongside a portion of the tray-walls of the crate-base;

forming a crate-tray from one of the crate-tray-forms, such that the tray-walls of the tray-deck extend downwards from the tray-deck, enclosing the top sides of the first set of crate-walls, the jointed-tabs on the crate-cover opened in their extended position;

forming a second crate by positioning a second set of crate-walls, consisting of at least one crate-wall from the plurality of crate-walls, on the crate-tray, the crate-ray acting now like an intermediate crate-base with extended jointed-tabs acting similar to the cover-walls of the crate-base;

repeating the steps of forming crates and crate-trays if desired to create a set of crates; and forming a crate-lid by positioning one of the of crate-tray-forms so that the cover-walls extend downward from the cover-deck and over the top-most set of crate-walls.

29. The method for transporting or displaying goods of claim 28, further comprising the step of fastening the jointed-tabs from each of the crate-trays to the plurality of crate-walls above the crate-trays.

30. The method for transporting or displaying goods of claim 29, wherein the step of fastening the jointed-tabs comprises stapling the jointed-tabs to the crate-walls with a stapler.

31. The method for transporting or displaying goods of claim 28, wherein the step of providing a plurality of crate-walls further comprises providing at least one knock-out window in the crate-walls; and the method further comprising the step of removing one or more of the knock-out windows from the crate-walls, for better displaying the goods stored within the confines of the crate-walls.

32. The method for transporting or displaying goods of claim 28, further comprising placing a crate-pad on the crate-tray for increasing the structural strength of the crate-tray.

33. The method for transporting or displaying goods of claim 28, further comprising the step of reversing the position of the crate-lid for creating a display shelf area.

34. The method for transporting or displaying goods of claim 28, further comprising the step of extending the jointed-tabs from the crate-lid to secure the crate-lid to the crate-walls immediately below the crate-lid.

35. The method for transporting or displaying goods of claim 28, wherein at least one of the crate-walls has printed material on the crate-wall.

36. The method for transporting or displaying goods of claim 28, further comprising the step of affixing printed material to at least one of the crate-walls for display purposes.

37. The method for transporting or displaying goods of claim 28, further comprising the step of loading the crates with a plurality of components, the components used for the assembly of a manufactured item.

38. A set of crates, comprising:

at least one crate-tray, each crate-tray comprising a tray-deck, a plurality of tray-walls formed along the edges of the tray-deck, and a plurality of jointed-tabs and accompanying hinges, the jointed-tabs incised on the tray-deck and positioned with the hinges generally along the edges of the tray-deck, the jointed-tabs capable of extending from the tray-deck;

a plurality of crates, each crate having a top side and a bottom side;

a crate-cover, comprising a cover-deck and a plurality of cover-walls formed along the edges of the cover-deck; and a crate-base, comprising a base-deck and a plurality of base-walls formed along the edges of the base-deck;

wherein each of the crates is separated by a crate-tray, so that the crate-tray acts as a cover for the crate adjacent below the crate-tray and so the crate-tray acts as a base for the crate adjacent above the crate-tray;

wherein the crate-base acts as a base below the plurality of crates that are separated by crate-trays; and wherein the crate-cover acts as a cover above the plurality of crates that are separated by crate-trays.

39. The set of crates of claim 38, wherein the respective jointed-tabs on each crate-tray are extended and secured to the crate immediately above the crate-tray.

40. The set of crates of claim 39, wherein the respective jointed-tabs are secured to the crates with staples.

41. The set of crates of claim 39, wherein the respective jointed-tabs are secured to the crates with adhesive.

42. The set of crates of claim 39, wherein the respective jointed-tabs are secured to the crates with rivets.

43. The set of crates of claim 38, wherein the crate-base is formed from one of the crate-trays and the crate-cover is formed from one of crate-trays.

44. The set of crates of claim 38, wherein the hinges on each crate-tray are scored lines generally along the edges of the crate-tray.

45. The set of crates of claim 38, wherein the hinges on each crate-tray are compressed lines generally along the edges of the crate-tray, for enabling the jointed-tabs to hinge without the tendency to overextend.

46. The set of crates of claim 38, wherein the crate have at least one knock-out window, for allowing goods that are in the set of crates to be displayed.

47. The set of crates of claim 38, further comprising at least one crate-pads, each crate-pad situated on directly adjacent to one of the crate-trays, for increasing the structural strength of the set of crates.

48. The set of crates of claim 38, wherein at least one of the crates have printed material printed thereon.

49. The set of crates of claim 38, wherein at least one of crates can have printed materials affixed thereon.

50. The set of crates of claim 38, wherein the crate-trays further have a plurality of wall-tabs extending from the tray-deck generally along the tray-walls and generally perpendicular to the tray-deck, the wall-tabs formed as appendages of the tray-walls, wherein the tray-deck, the tray-walls, and the wall-tabs are formed from a single piece of material that is folded and secured.

* * * * *

UNITED STATES PATENT AND TRADEMARK OFFICE

CERTIFICATE OF CORRECTION

PATENT NO. : 6,488,200 B1
DATED : December 3, 2002
INVENTOR(S) : Robert F. Jensen, Jr.

It is certified that error appears in the above-identified patent and that said Letters Patent is hereby corrected as shown below:

Column 3,
Line 21, delete the word “comer” and insert -- corner --

Column 11,
Line 26, delete the word “ray” and insert -- tray --

Signed and Sealed this

Twenty ninth Day of April, 2003

JAMES E. ROGAN
*Director of the United States Patent and Trademark Office*